US009021828B2

(12) United States Patent
Vitan et al.

(10) Patent No.: US 9,021,828 B2
(45) Date of Patent: May 5, 2015

(54) ICE BOX HOUSING ASSEMBLY AND RELATED REFRIGERATION APPLIANCE

(75) Inventors: Craig Robert Vitan, Louisville, KY (US); Umakant Suresh Katu, Hyderabad (IN); Steven D. Paul, Louisville, KY (US); Eric Lloyd Scalf, Louisville, KY (US); Andrew Reinhard Krause, La Grange, KY (US); Edward Philip Strauss, Louisville, KY (US); Danister Abeygunawardana, Louisville, KY (US)

(73) Assignee: General Electric Company, Schenectady, NY (US)

( * ) Notice: Subject to any disclaimer, the term of this patent is extended or adjusted under 35 U.S.C. 154(b) by 289 days.

(21) Appl. No.: 13/170,640

(22) Filed: Jun. 28, 2011

(65) Prior Publication Data

US 2013/0000345 A1 Jan. 3, 2013

(51) Int. Cl.

| | |
|---|---|
| ***F25D 25/00*** | (2006.01) |
| ***F25C 5/18*** | (2006.01) |
| ***F25C 1/00*** | (2006.01) |
| ***F25B 39/02*** | (2006.01) |
| ***F25C 5/00*** | (2006.01) |
| ***F25D 23/02*** | (2006.01) |
| *F25D 23/04* | (2006.01) |
| *F25D 21/04* | (2006.01) |
| *F25D 23/06* | (2006.01) |

(52) U.S. Cl.

CPC ..... *F25C 5/005* (2013.01); *F25D 23/04* (2013.01); *F25D 21/04* (2013.01); *F25D 23/028* (2013.01); *F25D 23/066* (2013.01)

(58) Field of Classification Search

CPC ..... F25C 5/007; F25D 23/04
USPC ..... 62/66, 71, 275, 344, 353, 516, 517, 62/451, 377; 312/406
See application file for complete search history.

(56) References Cited

U.S. PATENT DOCUMENTS

| | | | | | |
|---|---|---|---|---|---|
| 2,994,410 | A | * | 8/1961 | Burnett | 188/72.3 |
| 3,146,601 | A | * | 9/1964 | Gould | 62/3.6 |
| 4,707,401 | A | * | 11/1987 | Benford | 428/317.5 |
| 5,269,601 | A | * | 12/1993 | Williams et al. | 312/406.1 |
| 5,340,208 | A | * | 8/1994 | Hauck et al. | 312/406 |
| 5,374,118 | A | * | 12/1994 | Kruck et al. | 312/407 |
| 5,408,844 | A | | 4/1995 | Stokes | |
| 6,164,739 | A | * | 12/2000 | Schulz et al. | 312/406 |

(Continued)

FOREIGN PATENT DOCUMENTS

| | | | | | |
|---|---|---|---|---|---|
| WO | WO 2008080882 | A3 | * | 10/2008 | A47B 95/00 |
| WO | WO 2010026249 | A1 | * | 3/2010 | F25D 23/12 |

*Primary Examiner* — Cassey D Bauer
*Assistant Examiner* — Kirstin Oswald
(74) *Attorney, Agent, or Firm* — Dority & Manning, P.A.

(57) ABSTRACT

A refrigeration appliance includes a refrigerated cabinet with a cooled storage compartment, a door movable between a closed position closing the cooled storage compartment and an opened position allowing access to an interior of the cooled storage compartment, the door having an outer panel and a thermoformed liner attached to an inside of the outer panel, and an ice box frame attached to the thermoformed liner, the ice box frame being formed of injection molded plastic more rigid than the thermoformed liner and defining an ice compartment therein. At least one of an ice maker, an ice storage bin, and a motor for driving an ice storage bin auger is located in the ice compartment and attached to the door via the ice box frame. A related refrigeration appliance is also disclosed.

20 Claims, 7 Drawing Sheets

(56) References Cited

U.S. PATENT DOCUMENTS

| | | | | |
|---|---|---|---|---|
| 6,405,553 | B1 | 6/2002 | Willett | |
| 6,952,936 | B2 * | 10/2005 | Sannasi et al. | 62/344 |
| 7,028,725 | B2 | 4/2006 | Hooker | |
| 7,188,479 | B2 | 3/2007 | Anselmino et al. | |
| 7,216,499 | B2 | 5/2007 | Flinner et al. | |
| 7,395,672 | B2 | 7/2008 | Krause | |
| 7,426,838 | B1 | 9/2008 | Shapiro et al. | |
| 7,469,553 | B2 * | 12/2008 | Wu et al. | 62/344 |
| 7,552,594 | B2 * | 6/2009 | Coulter et al. | 62/66 |
| 8,499,579 | B2 * | 8/2013 | Luisi et al. | 62/389 |
| 8,627,678 | B2 * | 1/2014 | Choi | 62/344 |
| 2004/0256965 | A1 * | 12/2004 | Koons | 312/405 |
| 2005/0194875 | A1 * | 9/2005 | Reed et al. | 312/405.1 |
| 2006/0082270 | A1 * | 4/2006 | Collins et al. | 312/405.1 |
| 2006/0086131 | A1 * | 4/2006 | Pastryk et al. | 62/344 |
| 2006/0196213 | A1 * | 9/2006 | Anderson | 62/344 |
| 2006/0196214 | A1 * | 9/2006 | Lee et al. | 62/344 |
| 2008/0190046 | A1 * | 8/2008 | Hecht et al. | 52/173.1 |
| 2009/0165492 | A1 * | 7/2009 | Wilson et al. | 62/344 |
| 2009/0166385 | A1 | 7/2009 | Davis et al. | |
| 2009/0211292 | A1 | 8/2009 | Smith et al. | |
| 2009/0229297 | A1 * | 9/2009 | Allard et al. | 62/449 |
| 2009/0249804 | A1 | 10/2009 | Davis et al. | |
| 2009/0249819 | A1 * | 10/2009 | Skinner | 62/344 |
| 2009/0293501 | A1 | 12/2009 | Kulkarni et al. | |
| 2010/0043457 | A1 * | 2/2010 | Wu et al. | 62/71 |
| 2010/0101258 | A1 | 4/2010 | Lee et al. | |
| 2010/0192608 | A1 * | 8/2010 | Lee et al. | 62/275 |
| 2010/0192614 | A1 * | 8/2010 | Kim et al. | 62/344 |
| 2010/0251748 | A1 | 10/2010 | Park et al. | |

* cited by examiner

ICE BOX HOUSING ASSEMBLY AND RELATED REFRIGERATION APPLIANCE

FIELD OF THE INVENTION

The subject matter disclosed herein relates to an ice box housing assembly for a refrigeration appliance.

BACKGROUND OF THE INVENTION

Various ice maker designs have been proposed for refrigeration appliances such as commercial or home refrigerators and/or freezers. In certain automatic ice makers, water is provided from an external source to a chilled ice cube mold. Once the water freezes into ice, the ice cubes in the mold are harvested and the cycle is repeated. An ice bucket is located below the ice maker to hold the ice cubes until they are dispensed to a user. Typically, ice cubes are dispensed by a user operating an input device such as a button or paddle which triggers a mechanical feeding of ice downwards to the user's container such as a cup. An auger may help break up and move the ice cubes, a trapdoor may be provided to maintain temperatures and feed upon demand, all controlled either by user input, the device, or both. Ice crushers and chilled water dispensers may also be located nearby depending on the device. The ice may be stored in the fresh food compartment, the freezer compartment, or on the door of either, depending on further design choices.

With all of these various options and functions, refrigeration appliances such as refrigerators and freezers have become complex and specialized designs are often employed. Interior liners are typically molded (thermoformed) sheets, and providing attachment of various optional and/or complex items such as above to refrigeration appliance interiors can be difficult. Customized designs may have to be employed to fit the desired parts into each such appliance. Doing so with a molded liner, which is typically not entirely rigid, can prove challenging for designers.

Accordingly, an improved ice box housing assembly allowing versatility and simplicity in design and installation for various applications would be welcome.

BRIEF DESCRIPTION OF THE INVENTION

Aspects and advantages of the invention will be set forth in part in the following description, or may be obvious from the description, or may be learned through practice of the invention. According to certain aspects of the disclosure, a refrigeration appliance includes a refrigerated cabinet with a cooled storage compartment, a door movable between a closed position closing the cooled storage compartment and an opened position allowing access to an interior of the cooled storage compartment, the door having an outer panel and a thermoformed liner attached to an inside of the outer panel, and an ice box frame attached to the thermoformed liner, the ice box frame being formed of injection molded plastic more rigid than the thermoformed liner and defining an ice compartment therein. At least one of an ice maker, an ice storage bin, and a motor for driving an ice storage bin auger is located in the ice compartment and attached to the door via the ice box frame. A related refrigeration appliance is also disclosed. Various options and modifications are possible.

According to certain other aspects of the disclosure, a housing assembly is provided for a refrigeration appliance outer door with an outer panel and a thermoformed liner attached to an inside of the outer panel, an ice maker and ice storage bin disposed within the outer door. The housing assembly includes a frame having walls including a base wall and side walls. The frame includes attachment structure to permit attachment of the frame to the thermoformed liner. The frame is formed of injection molded plastic more rigid than the thermoformed liner. The frame includes mounting structure for securing the ice maker and the ice storage bin therein. Again, various options and modifications are possible.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
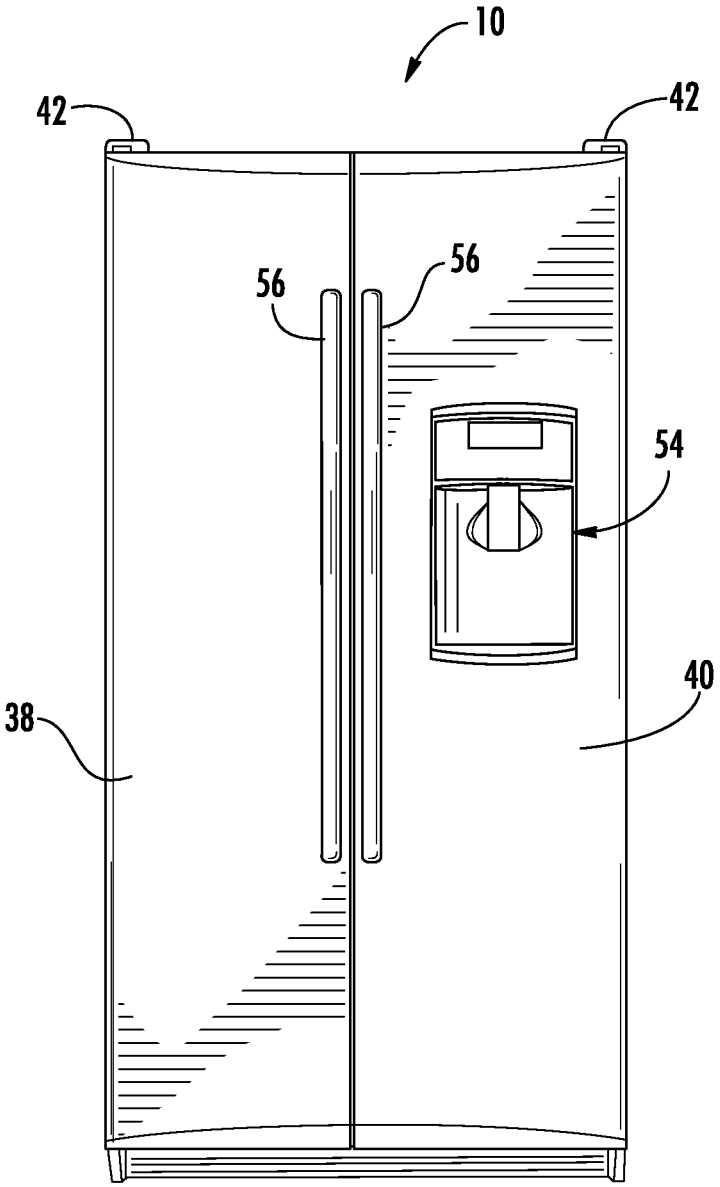
FIG. 1 provides a front view of a refrigeration appliance with its doors closed.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a perspective view of an exemplary refrigeration appliance 10 depicted as a refrigerator in which ice-box structures in accordance with aspects of the present disclosure may be utilized. It should be appreciated that the appliance of FIG. 1 is for illustrative purposes only and that the present invention is not limited to any particular type, style, or configuration of refrigeration appliance, and that such appliance may include any manner of refrigerator, freezer, refrigerator/freezer combination, and so forth. Therefore, the side-by-side doors of appliance 10, could be replaced with other designs, such as dual "French" doors for a top fresh food compartment with a single door for a bottom freezer.

Figure 2:
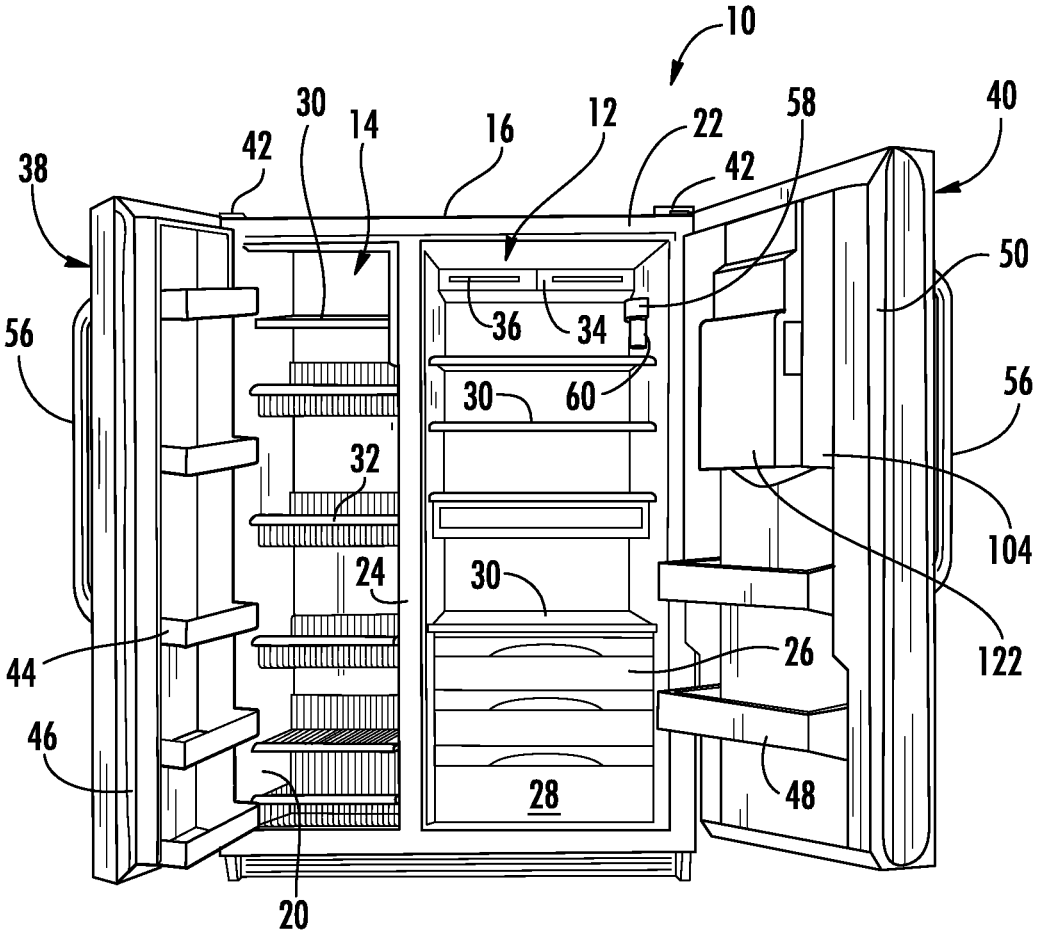
FIG. 2 provides a front view of the refrigeration appliance of FIG. 1 with its doors opened.
Figure 3:
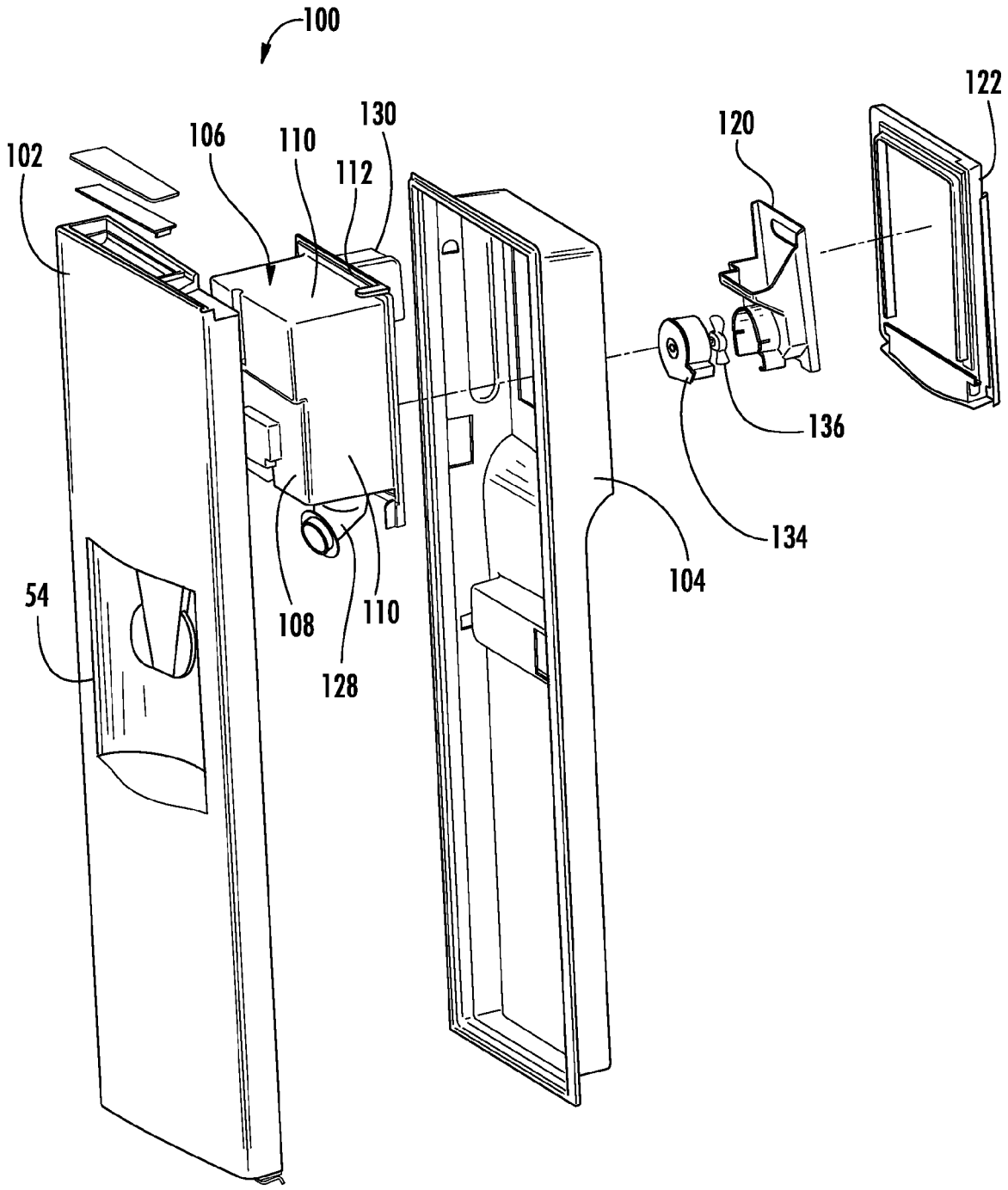
FIG. 3 provides an exploded perspective view of the refrigeration appliance door of FIG. 1 showing an ice box.
Figure 4:
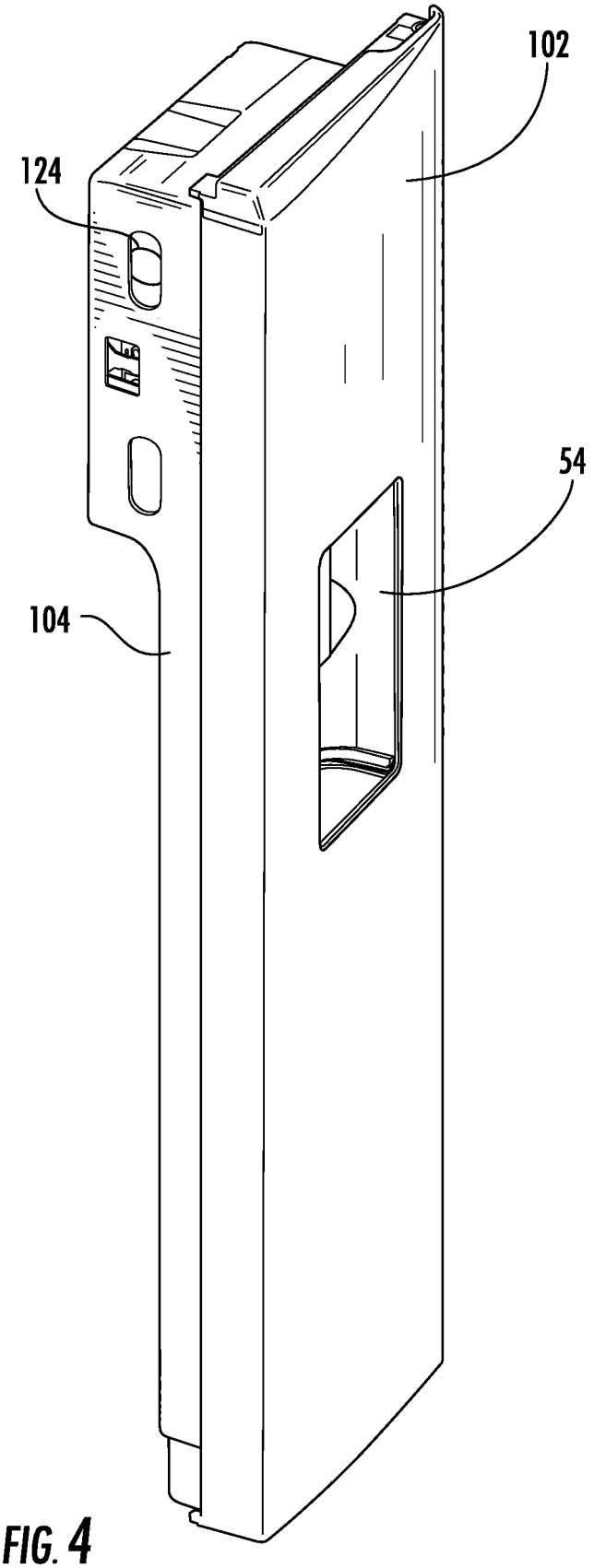
FIG. 4 provides a side perspective view of the door of FIG. 3.
Figure 5:
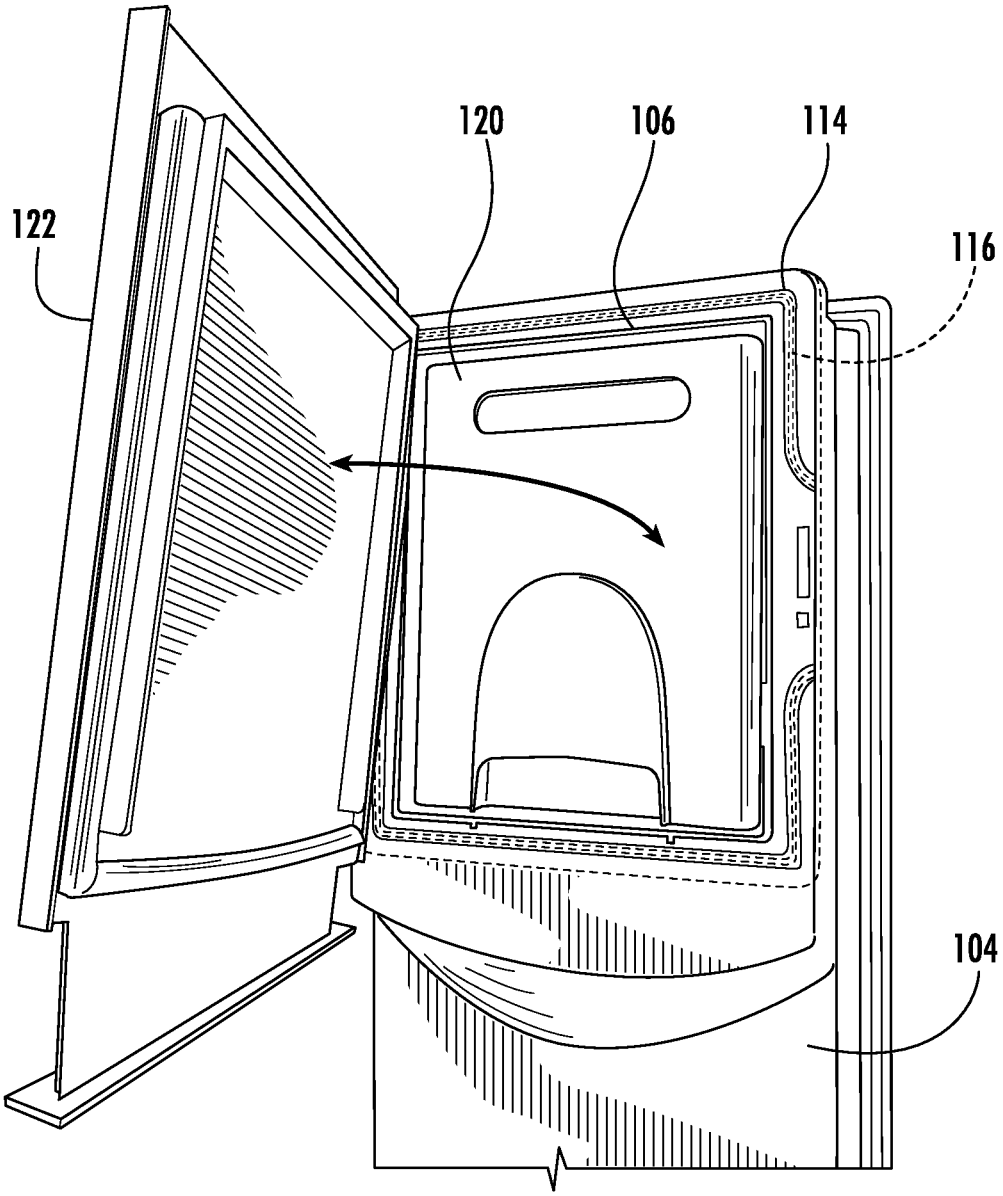
FIG. 5 provides a closeup perspective view of a portion of the door of FIG. 5 with an ice bucket in place.

Referring to FIG. 2, the refrigerator 10 as shown comprises a refrigerated cabinet including a fresh food storage compartment 12 and a freezer storage compartment 14, with the compartments arranged side-by-side and contained within an outer case 16 and inner liners 18 and 20 generally molded from a suitable plastic material. In smaller refrigerators 10, a single liner is formed and a mullion spans between opposite sides of the liner to divide it into a freezer storage compartment and a fresh food storage compartment. The outer case 16 is normally formed by folding a sheet of a suitable material, such as pre-painted steel, into an inverted U-shape to form top and side walls of the outer case 16. A bottom wall of the outer case 16 normally is formed separately and attached to the case side walls and to a bottom frame that provides support for refrigerator 10.

A breaker strip 22 extends between a case front flange and outer front edges of inner liners 18 and 20. The breaker strip 22 is formed from a suitable resilient material, such as an extruded acrylo-butadiene-styrene based material (commonly referred to as ABS). The insulation in the space between inner liners 18 and 20 is covered by another strip of suitable resilient material, which also commonly is referred to as a mullion 24 and may be formed of an extruded ABS material. Breaker strip 22 and mullion 24 form a front face, and extend completely around inner peripheral edges of the outer case 16 and vertically between inner liners 18 and 20.

Slide-out drawers 26, a storage bin 28 and shelves 30 are normally provided in fresh food storage compartment 12 to support items being stored therein. In addition, at least one shelf 30 and at least one wire basket 32 are also provided in freezer storage compartment 14.

The refrigerator features are controlled by a controller 34 according to user preference via manipulation of a control interface 36 mounted in an upper region of fresh food storage compartment 12 and coupled to the controller 34. As used herein, the term "controller" is not limited to just those integrated circuits referred to in the art as microprocessor, but broadly refers to computers, processors, microcontrollers, microcomputers, programmable logic controllers, application specific integrated circuits, and other programmable circuits, and these terms are used interchangeably herein.

A freezer door 38 and a fresh food door 40 close access openings to freezer storage compartment 14 and fresh food storage compartment 12. Each door 38, 40 is mounted by a top hinge 42 and a bottom hinge (not shown) to rotate about its outer vertical edge between a closed position, as shown in FIG. 1, and an opened position, as shown in FIG. 2. The freezer door 38 may include a plurality of storage shelves 44 and a sealing gasket 46, and fresh food door 40 also includes a plurality of storage shelves 48 and a sealing gasket 50. An ice box housing assembly 100 is also provided as part of fresh food door 40, and will be discussed in greater detail below.

The refrigeration appliance 10 may include an automatic ice maker in some location as discussed below, and a dispenser 54 provided in the fresh food door 40, such that ice and/or chilled water can be dispensed without opening either door 38 or 40. Doors 38 and 40 may be opened by handles 56 is conventional. A housing 58 may hold a water filter 60 used to filter water for the ice maker and/or dispenser. The ice maker may be located within assembly 100 or within freezer storage compartment 14.

As with known refrigerators, the refrigerator 10 also includes a machinery compartment (not shown) that at least partially contains components for executing a known vapor compression cycle for cooling air. The components include a compressor, a condenser, an expansion device, and an evaporator connected in series as a loop and charged with a refrigerant. The evaporator is a type of heat exchanger which transfers heat from air passing over the evaporator to the refrigerant flowing through the evaporator, thereby causing the refrigerant to vaporize. The cooled air is used to refrigerate one or more refrigerator or freezer compartments via fans. Also, a cooling loop can be added to direct cool the ice maker to form ice cubes, and a heating loop can be added to help remove ice from the ice maker. Collectively, the vapor compression cycle components in a refrigeration circuit, associated fans, and associated compartments are conventionally referred to as a sealed system. The construction and operation of the sealed system are well known to those skilled in the art.

FIGS. 3-8 show more detailed views of one example of the ice box housing assembly 100. As shown, the housing assembly is applied to door 40 of fresh food compartment 12, but it could just as easily be located in door 38 of freezer compartment 14 or other appliance/door designs, as discussed above.

As illustrated, door 40 is an outer door movable between a closed position (FIG. 1) closing compartment 12 and an opened position (FIG. 2) allowing access to the interior the compartment. Door 40 has an outer panel 102 and a thermoformed liner 104 attached to an inside of the outer panel. Typically, outer panel 102 includes a main body formed of a structurally firm metal material such as steel, stainless steel, aluminum, etc. Outer panel 102 may also have multiple inner and outer layers (not shown) as is known to provide coloring, fingerprint and smudge avoidance, insulation adhesion, etc. Liner 104 is a thermoformed plastic such as ABS (acrylonitrile butadiene styrene—thermoform grade). Insulation (not shown) such as expandable foam can be present between outer panel and liner 104.

Ice box frame 106 is attached to thermoformed liner 104, for example by fasteners such as screws, rivets, etc., slots and tabs, adhesives, etc. Foaming in of insulation can further hold frame 106 in place. Ice box frame 106 is formed of injection molded plastic such as HIPS (high impact polystyrene—injection molding grade) or ABS (injection molding grade), more rigid than that of the thermoformed liner. Accordingly, frame 106 provides a rigid frame on which various elements can be mounted to door 40.

Frame 106 includes a base wall 108, side walls 110, and an attachment structure such as an outer flange 112. Flange 112 may have a groove 114 in it to receive a heating element 116. Heating element 116 may be provided between frame 106 and liner 104 to prevent or reduce undesired condensation in view of the fact that frame 106 may be located within a door 40 of a fresh food compartment at a different temperature than the sub-freezing temperature inside of the frame. Heating element 116 also prevents undesired freezing of any condensation that might form at such location. Heating element 116 may be a strip resistance heater located in a groove in flange 112 as shown, or may be thermoformed into the flange or attached to liner 104 adjacent he flange.

Frame 106 includes an interior area 118 or ice compartment in which an ice bucket 120 or ice bin may be removably located. An inner door 122 may enclose interior area 118 and any items therein, including ice in ice bucket 120. Accordingly, inner door 122 can be used to maintain interior area 118 at a temperature lower than that of fresh food compartment 12, for example below freezing. Door 122 can be hinged to liner 104 or frame 106, or simply removable from such elements. To cool interior area 118 to such a temperature, frame 106 defines openings 124 to allow circulation of air from freezer storage compartment 14. Accordingly, interior area 118 need not be separately cooled, although a fan or other device may be employed to move cooled air from freezer compartment 14 into the interior area. An outlet opening 126 is provided to feed ice cubes from interior area 118 and ice bucket 120 through a passageway 128 and through conventional dispenser 54. Heater 116 prevents condensation that may occur at an outer edge of frame 106 near flange 112 and liner 104 from freezing and possibly making it more difficult to open door 122.

Figure 6:
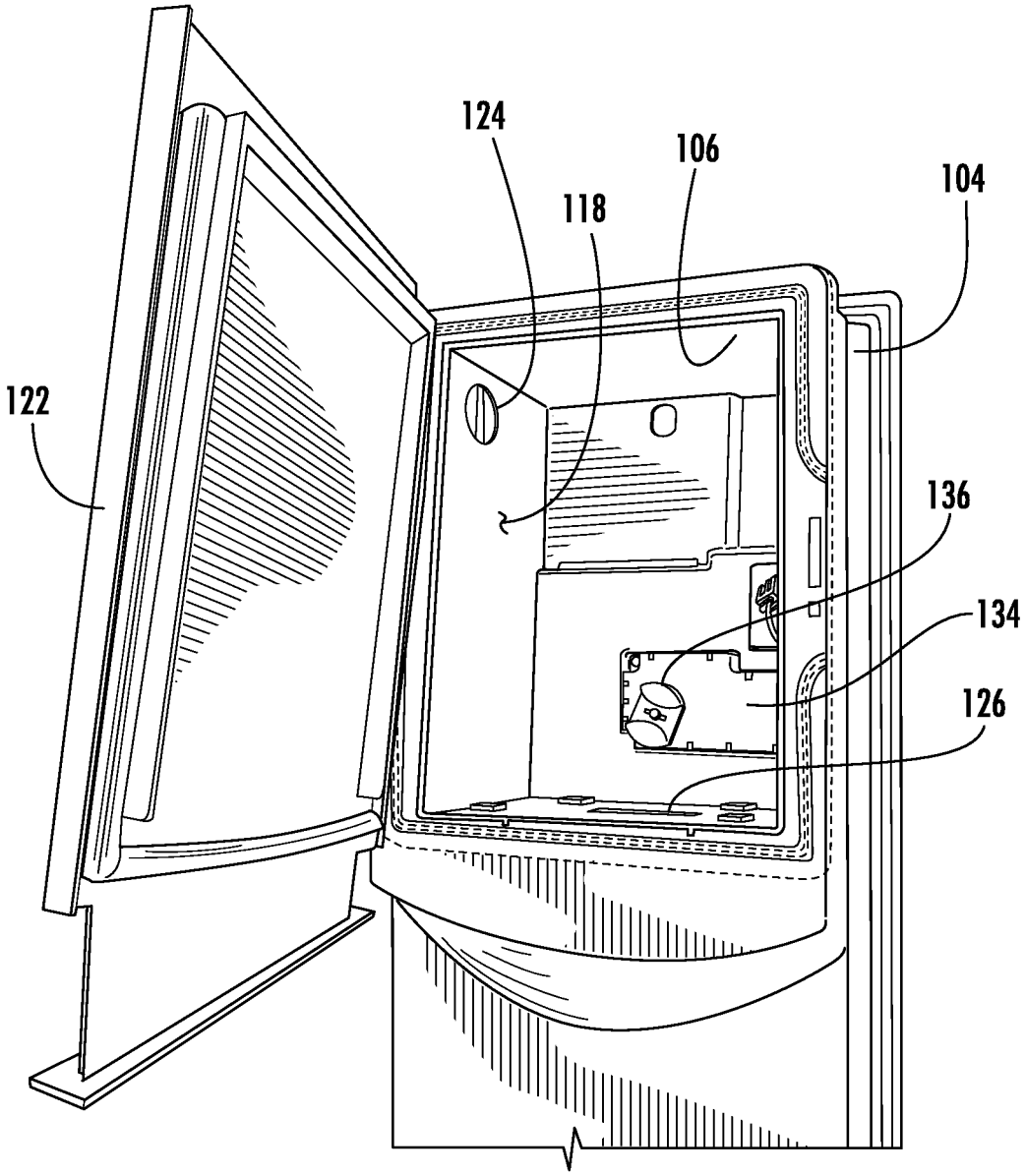
FIG. 6 provides a closeup perspective view of a the portion of the door of FIG. 6 with the ice bucket removed.
Figure 7:
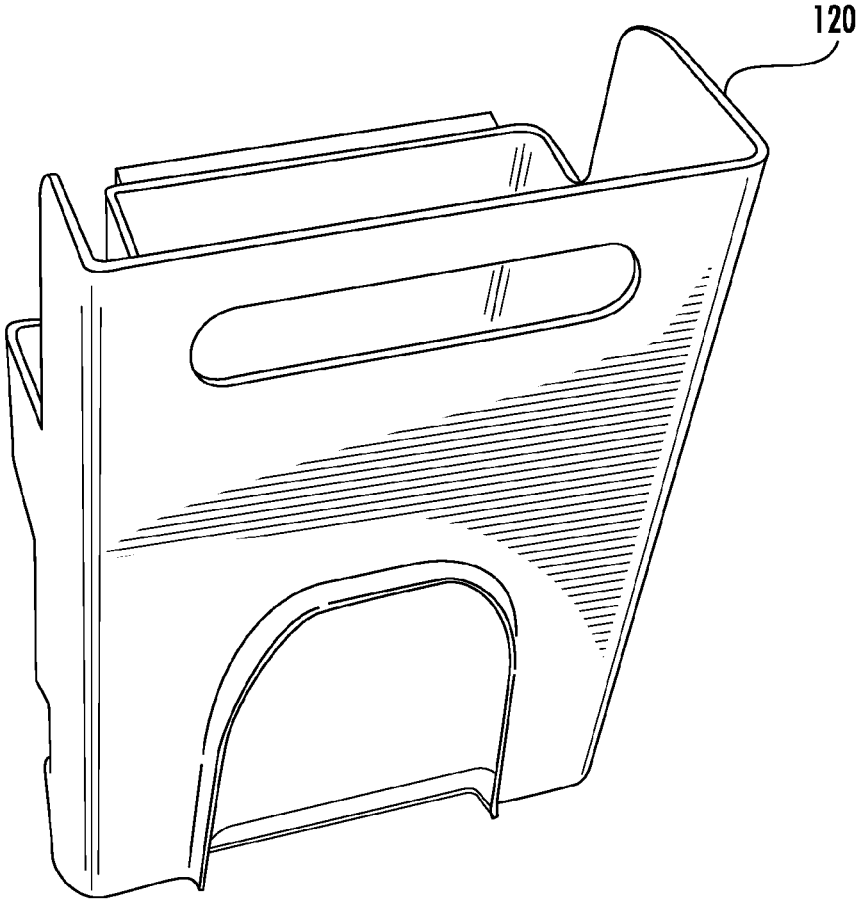
FIG. 7 provides a top perspective view of the ice bucket of FIG. 5.
Figure 8:
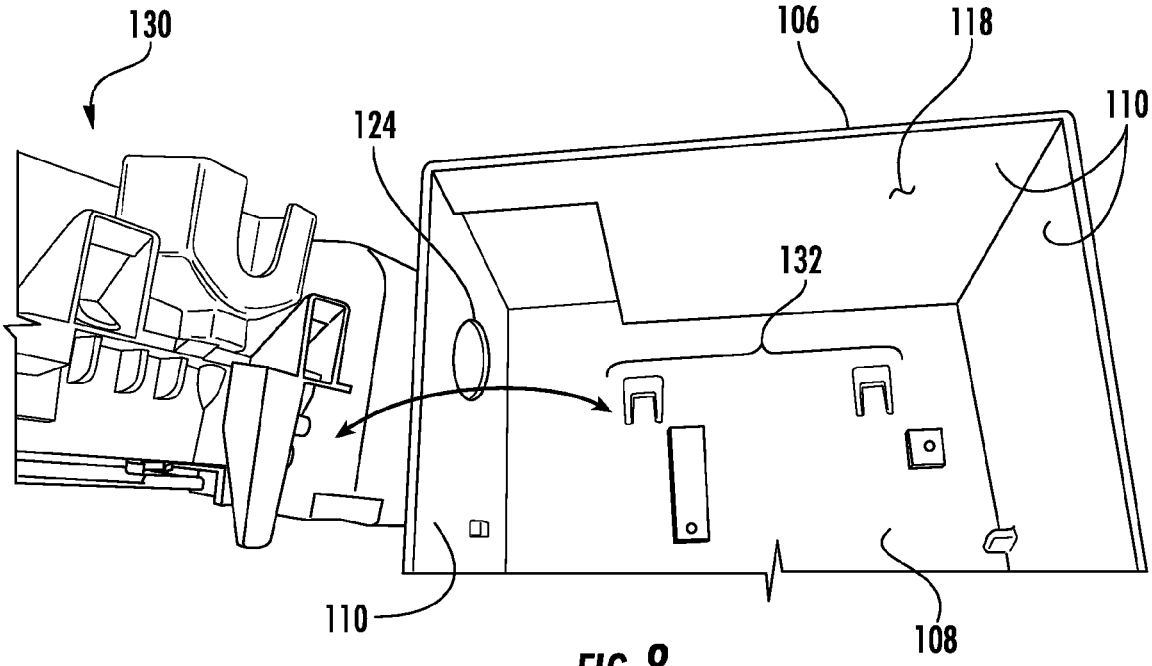
FIG. 8 provides a closeup partial view of the interior of the ice box of FIG. 3 and a portion of an ice maker.

An ice maker 130 may be readily attached to frame 106, for example by attachment to elements 132 on base wall 108 as shown, or to side walls 110. FIG. 8 shows an ice maker 130 in a removed position adjacent frame, and FIG. 6 shows frame 106 with no ice maker or ice bucket 120. A motor 134 for driving an auger 136 for assisting in moving ice cubes from ice bucket 120 can also be mounted directly to frame 106.

Various elements can be attached directly to frame 106, as mentioned above. Accordingly, because the frame is more rigid than the liner, a more secure attachment and resulting structure can be achieved than if the frame were simply an extension of the thermoformed liner. Further a modular structure can be achieved wherein elements attached within the frame can be similar across different appliances. An opening sized to receive frame 106 with suitable electrical, liquid, and mechanical attachments can be provided within thermoformed liner 104. Thus, at least one of an ice maker, an ice storage bin, and a motor for driving an ice storage bin auger can be located in the frame and attached to the door via the frame. If desired, all three of such items may be attachable to an inside of the frame. An optional heater 116 can be employed to reduce or prevent condensation and prevent icing that would make opening of door 122 difficult.

In view of the above, various options for an ice box and a related refrigeration appliance are disclosed wherein the rigid ice box is attachable to the inner liner of the refrigeration appliance. The designs are modular, and subject to modification and application across different models and using different options.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigeration appliance comprising:

a refrigerated cabinet including a cooled storage compartment;

a door movable between a closed position closing the cooled storage compartment and an opened position allowing access to an interior of the cooled storage compartment, the door having an outer panel and a thermoformed liner attached to an inside of the outer panel, the thermoformed liner positioned at the cooled storage compartment when the door is in the closed position;

an ice box frame attached to the thermoformed liner such that the ice box frame is positioned between the thermoformed liner and outer panel, the ice box frame being formed of injection molded plastic such that the ice box frame is more rigid than the thermoformed liner, the ice box frame defining an ice compartment therein, the ice box frame and the thermoformed liner being discrete from one another, the ice box frame having a back wall positioned at the outer panel, the ice box frame also haying side walls that extend from the back wall to the thermoformed liner, the thermoformed liner defining a passage for accessing the ice compartment of the ice box frame;

an inner panel mounted to the thermoformed liner at the passage of the thermoformed liner in order to selectively enclose the ice compartment of the ice box frame, the inner panel positioned between the ice compartment of the ice box frame and the cooled storage compartment when the door is in the closed position;

insulation extending between the outer panel and the thermoformed liner, the insulation also supporting the ice box frame between the outer panel and the thermoformed liner; and an ice maker and an ice storage bin located in the ice compartment, the ice maker mounted to the ice box frame within the ice compartment of the ice box frame.

2. The refrigeration appliance of claim 1, wherein the side walls of the ice box frame include four side walls mounted to one another in a rectangular shape.

3. The refrigeration appliance of claim 1, further including a heater located along a portion of the ice box frame adjacent the thermoformed liner.

4. The refrigeration appliance of claim 1, wherein the cooled storage compartment is a fresh food storage compartment.

5. The refrigeration appliance of claim 4, wherein the ice box frame defines openings to allow circulation of air from a freezer storage compartment within the refrigerated cabinet.

6. The refrigeration appliance of claim 1, further comprising a motor for driving an ice storage bin auger, the motor mounted to an interior wall of the ice box frame.

7. The refrigeration appliance of claim 1, wherein the ice box frame defines an outlet opening to allow passage of ice cubes out of the ice storage bin, the outlet opening positioned at a bottom of the ice box frame.

8. The refrigeration appliance of claim 7, further including a passageway extending from the outlet opening through the door for travel of ice cubes through the door.

9. The refrigeration appliance of claim 1, wherein the ice maker is mounted to an interior wall of the ice box frame.

10. The refrigeration appliance of claim 1, wherein the ice storage bin is removably attachable to the ice box frame.

11. A refrigeration appliance comprising:

a refrigerated cabinet including a fresh food chamber and a freezer chamber;

a door mounted to the refrigerated cabinet at the fresh food chamber, the door movable between a closed position closing the fresh food chamber and an opened position allowing access to the fresh food chamber, the door having an outer panel and a thermoformed liner attached to the outer panel, the thermoformed liner positioned at the fresh food chamber when the door is in the closed position;

an ice box frame attached to the thermoformed liner such that the ice box frame is positioned between the thermoformed liner and outer panel, the ice box frame and the thermoformed liner being discrete from one another, the ice box frame formed of injection molded plastic such that the ice box frame is more rigid than the thermoformed liner, the ice box frame having a back wall positioned at the outer panel, the ice box frame also having side walls that extend from the back wall to the thermoformed liner, the ice box frame defining an ice compartment therein, the thermoformed liner defining a passage for accessing the ice compartment of the ice box frame;

an inner panel mounted to the thermoformed liner at the passage of the thermoformed liner in order to selectively enclose the ice compartment of the ice box frame, the inner panel positioned between the ice compartment of the ice box frame and the fresh food chamber when the door is in the closed position;

insulation extending between the outer panel and the thermoformed liner, the insulation at least partially encasing the ice box frame in order to support the ice box frame between the outer panel and the thermoformed liner; and an ice maker and an ice storage bin located in the ice compartment, the ice maker mounted to the ice box frame within the ice compartment of the ice box frame.

12. The refrigeration appliance of claim 11, wherein the ice box frame includes a flange extending about the passage of the thermoformed liner, the flange positioned on the thermoformed liner.

13. The refrigeration appliance of claim 12, further including a heater extending between the flange of the ice box frame and the thermoformed liner at the passage of the thermoformed liner.

14. The refrigeration appliance of claim 11, wherein the fresh food chamber is positioned above the freezer chamber within the refrigerated cabinet.

15. The refrigeration appliance of claim 14, wherein the ice box frame defines openings configured for receiving air from the freezer chamber within the ice compartment of the ice box frame.

16. The refrigeration appliance of claim 11, further comprising a motor for driving an ice storage bin auger, the motor mounted to an interior wall of the ice box frame.

17. The refrigeration appliance of claim 11, wherein the ice box frame defines an outlet opening to allow passage of ice cubes out of the ice storage bin, the outlet opening positioned at a bottom of the ice box frame.

18. The refrigeration appliance of claim 17, further including a passageway extending from the outlet opening through the door for travel of ice cubes through the door.

19. The refrigeration appliance of claim 11, wherein the ice maker is mounted to hooks on an interior wall of the ice box frame.

20. The refrigeration appliance of claim 11, Wherein the ice storage bin is removably attachable to the ice box frame.

* * * * *